United States Patent [19]

Makamura

[11] Patent Number: 4,981,313

[45] Date of Patent: Jan. 1, 1991

[54] STRIKER FOR AUTOMOTIVE DOOR LOCKING APPARATUS

[75] Inventor: Shuji Makamura, Utsunomiya, Japan

[73] Assignee: Mitsui Kinzoku Kogyo Kabushiki Kaisha, Tokyo, Japan

[21] Appl. No.: 329,605

[22] Filed: Mar. 28, 1989

[30] Foreign Application Priority Data

Mar. 28, 1988 [JP] Japan ..... 63-40629[U]

[51] Int. Cl.[5] ..... E05C 21/02

[52] U.S. Cl. ..... 292/340; 292/DIG. 38; 292/DIG. 56

[58] Field of Search ..... 292/216, 340, 341.12, 292/341.11, DIG. 38, DIG. 56, DIG. 53

[56] References Cited

U.S. PATENT DOCUMENTS 4,466,645 8/1984 Kobayashi ..... 292/341.12
4,470,626 9/1984 Gergoe et al. ..... 292/DIG. 56 X
4,834,435 5/1989 Kleefeldt ..... 292/340

FOREIGN PATENT DOCUMENTS 166964 10/1987 Japan .

*Primary Examiner*—Richard E. Moore
*Attorney, Agent, or Firm*—Browdy and Neimark

[57] ABSTRACT

The striker for automotive door locking apparatuses has a metal base secured to the car body and a roughly U-shaped metal rod mounted on the metal base, with the surface of the metal base and the metal rod coated with a synthetic resin layer. An engagement surface is formed at the back periphery of the metal base along the entire circumference. The synthetic resin layer is formed integral with claw portions that engage with the engagement surface of the metal base. The underside of the claw portion of the synthetic resin is flush with the back of the metal base.

2 Claims, 2 Drawing Sheets

STRIKER FOR AUTOMOTIVE DOOR LOCKING APPARATUS

BACKGROUND OF THE INVENTION

This invention relates to a striker for automotive door locking apparatuses. The striker for commonly known door locking apparatuses, as shown in FIG. 7, consists of a vertical metal base A mounted to the car body and a roughly U-shaped metal rod B mounted on the base A. For improved appearance and reduced noise, a synthetic resin layer D may be coated over the surface of the base A and the rod B (Japanese Utility Model Application No. 166964/1987).

In the above known example, since the synthetic resin layer D is not coated on the side surface E and the back surface F of the base A, the boundary between the side surface E and the synthetic resin layer D easily shows. Another drawback of this construction is that the synthetic resin layer D easily flakes off. Thus, the strikers commonly available on the market mostly have the synthetic resin layer D coated only over the surface of the rod B.

SUMMARY OF THE INVENTION

The object of this invention is to provide a striker for automotive door locking apparatuses which has a good appearance and in which the synthetic resin layer will not easily flake off.

DETAILED DESCRIPTION OF THE PREFERRED EMBODIMENT

Figure 1:
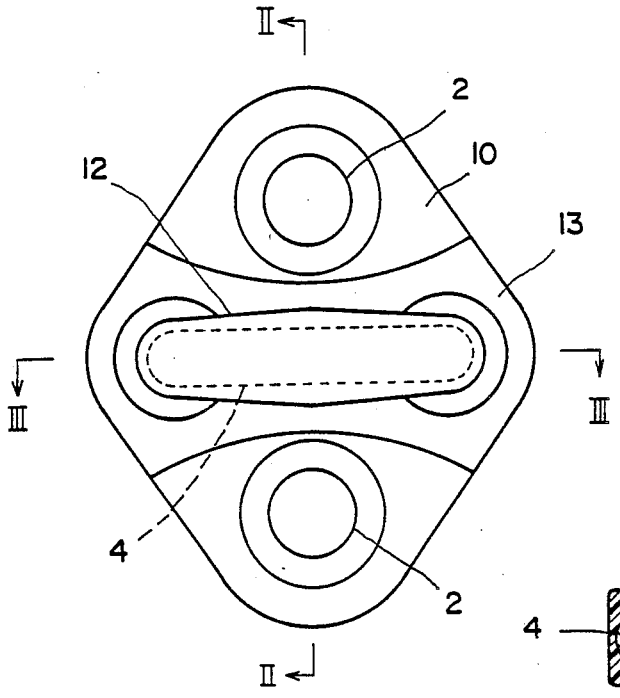
FIG. 1 is a front view of the striker according to this invention.
Figure 2:
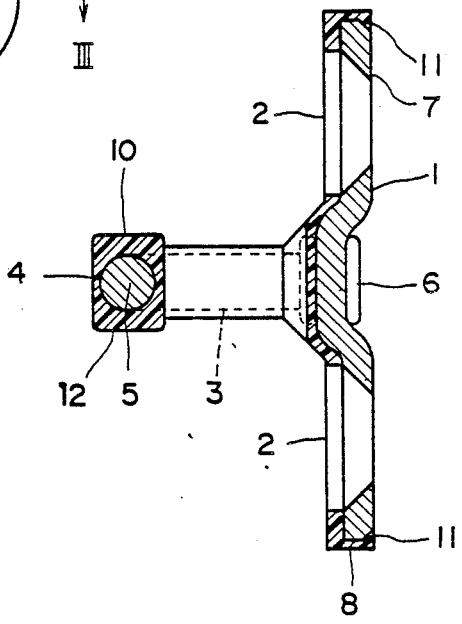
FIG. 2 is a cross-sectional view taken along the line II—II of FIG. 1.
Figure 3:
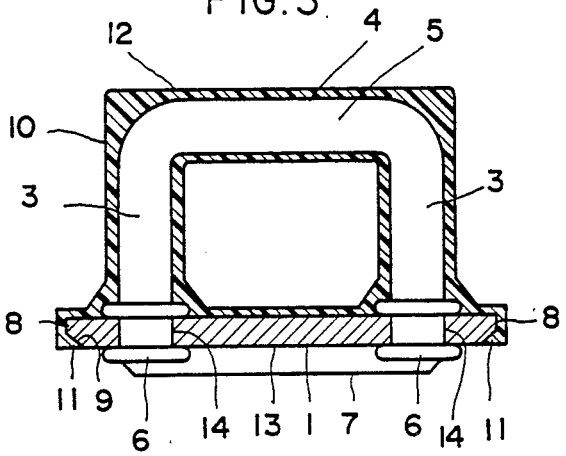
FIG. 3 is a cross-sectional view taken along the line III—III of FIG. 1.

One embodiment of the invention will be decribed in the following. Reference numeral 1 represents a metal base for the striker which has a bulged portion 13 at the center and mounting holes 2 on the upper and lower sides of the bulged portion 13. Bolts or screws are passed through the mounting holes 2 to fasten the striker base to the car body so that it is vertically secured.

Denoted 5 is a metal rod which has a horizontal portion 4 and legs 3 that are bent at right angles from each end of the horizontal portion 4, so that it is roughly U-shaped. Free ends 6 of the legs 3 are inserted through holes 14 in the bulged portion 13 and rigidly secured there by heat caulking.

Figure 4:
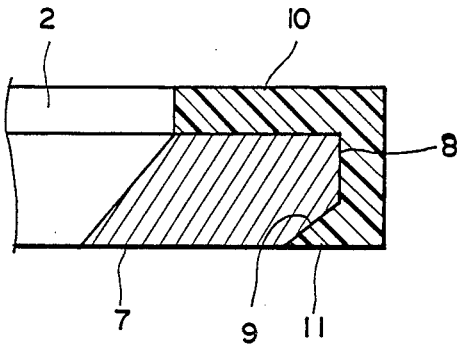
FIG. 4 is an enlarged cross-sectional view of the end of the striker.
Figure 5:
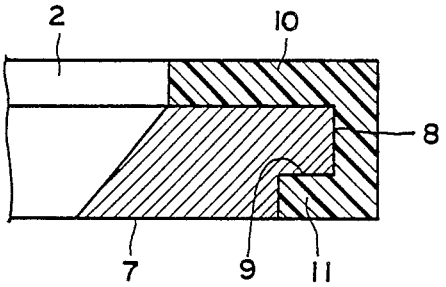
FIGS. 5 and 6 are enlarged cross-sectional views of another engagement surface, respectively.
Figure 6:
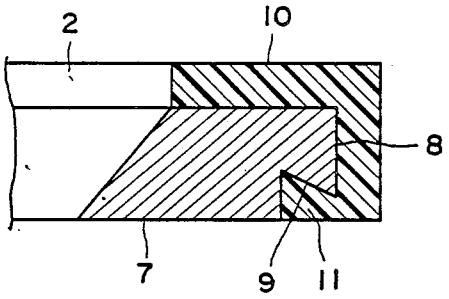
Figure 7:
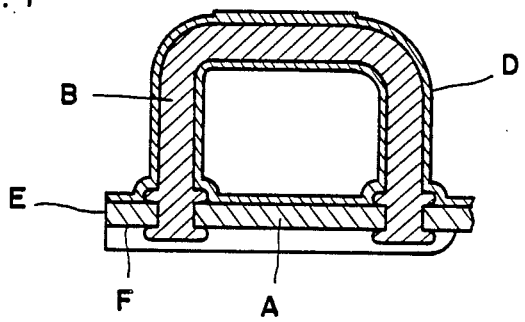
FIG. 7 is a lateral cross-sectional view to the conventional striker.

An engagement surface 9 is formed at the corner between the back surface 7 and the side surface 8 of the base 1 along the entire circumference. The engagement surface 9 is various in form. FIG. 4 shows an inclined surface whose angle is formed at about 45°. FIG. 5 shows a surface parallel to the back surface 7 and FIG. 6 shows an opposite inclined surface.

The surface of the striker of the above construction, i.e., the entire surface except for the back surface 7 and the mounting holes 2, are covered with a molded synthetic resin layer 10. A claw portion 11 that engages with the enggement surface 9 is formed integral with the synthetic resin layer 10. The back surface 7 of the base 1 and the back of the claw portion 11 may preferably be formed flush with each other.

The horizontal portion 4 of the rod 5 may be provided with a tapered portion 12 which is formed of the synthetic resin layer 10 and tapered according to the shape of the striker advancement groove in the lock body.

Next, we will explain advantages of this invention.

The striker of the invention can be formed by inserting the legs 3 of the rod 5 into the holes 14 of the base 1, securing the legs 3 by heat caulking, placing the assembled striker in a die so that the back surface 7 and rthe mounting holes 2 will not be coated with the synthetic resin layer, injecting synthetic resin liquid into the die, and letting the resin solidify. In this way the striker can easily be formed.

Since the entire external surface of the base 1, excluding the back surface 7 and the mounting holes 2, are covered with the synthetic resin layer 10, no metal surface will be exposed from the side surface 8 of the base 1, improving the appearance of the striker. Further, since the engagement surface formed at the corner portion between the back surface 7 and the side surface 8 of the base 1 is engaged with the claw portion 11 of the synthetic resin layer 10 along the entire circumference, the synthetic resin layer 10 will not easily peel off from the base 1. When the striker is installed on the car body, the claw portion 11 is clamped between the car body and the engagement surface 9, making it more difficult for the synthetic resin layer 10 to come off.

I claim:

1. A striker for automotive door locking apparatuses comprising:

a metal base secured to car body, the metal base having its surface coated with a synthetic resin layer;

a roughly U-shaped metal rod mounted on the metal base, the rod having its surface coated with a synthetic resin layer;

said synthetic resin layer having an engagement surface parallel to or at an inclined angle to said base formed at a corner portion between the back and the side of the metal base along the entire circumference; and wherein the synthetic resin layer is provided with integral claw portions that engage with said engagement surface of the metal base.

2. A striker for automotive door locking apparatuses comprising:

a metal base secured to a car body, said metal base having its surface coated with a synthetic resin layer;

a roughly U-shaped metal rod mounted on said metal base, said rod having its surface coated with a synthetic resin layer; and an engagement surface formed at a corner portion between the back and the side surface of the metal base along the entire circumference; whereby the synthetic resin layer is provided with and formed integral with claw portions that engage with the engagement surface of the metal base, and an underside of the claw portion of the synthetic resin layer is flush with the back of the metal base.

* * * * *